United States Patent [19]

Gulino

[11] Patent Number: 4,745,830

[45] Date of Patent: May 24, 1988

[54] CARPET INSTALLATION TOOL

[76] Inventor: Roy A. Gulino, 505 E. County Line Rd., Lakewood, N.J. 08701

[21] Appl. No.: 838,241

[22] Filed: Mar. 10, 1986

[51] Int. Cl.[4] ..... B25G 3/00

[52] U.S. Cl. ..... 81/488; 7/103; 294/8.6; 254/212

[58] Field of Search ..... 81/484–488; 7/103; 254/206, 209, 210, 211, 212; 294/8.6

[56] References Cited

U.S. PATENT DOCUMENTS 179,718 7/1876 Miller ..... 7/103

476,960 6/1892 Moore ..... 254/211

*Primary Examiner*—Frederick R. Schmidt

*Assistant Examiner*—Maurina Rachuba

*Attorney, Agent, or Firm*—Lerner, David, Littenberg, Krumholz & Mentlik

[57] ABSTRACT

A tool is described for installing carpet around a projection such as the nose of a stair tread projecting outwardly from an underlying riser. The tool is constructed from a body having a plurality of teeth for engaging the carpet and a lower terminal end adapted for forcing the carpet into the corner formed by the intersection of the nose and underlying riser. The tool permits the installation of a continuous length of carpet over a plurality of stairs without the necessity of having to cut the carpet into multiple segments. Four embodiments of a tool constructed in accordance with the present invention are described.

8 Claims, 2 Drawing Sheets

CARPET INSTALLATION TOOL

BACKGROUND OF THE INVENTION

The present invention relates in general to a carpet installation tool and, more particularly, to a tool for installing carpet around the nose of a stair tread projecting outwardly from an underlying riser or other such projection and the like.

The installation of various types of carpeting over a floor and, in particular, adjacent an upstanding wall is generally a simple task. For example, after securing a strip having projecting nails around the circumference of the area to be carpeted, a carpet installation tool is used to stretch the carpet over the projecting nails and to secure same thereto adjacent the upstanding wall. This tool is generally constructed from a rectangular block having a plurality of downwardly facing teeth and an extending handle having a padded terminal end. The carpet is installed by securing the block via the projecting nails to the carpet adjacent its peripheral edge and stretching the carpet over the projecting nails of the strip by kicking with one's knee the padded terminal end of the handle. Although this tool and carpet installation technique has been found suitable for installing carpet over relatively flat surfaces, such tool and technique is not suitable for use in installing carpet around a projection such as the nose of a stair tread which projects outwardly from its underlying riser. The installation of carpet around the nose of such a stair tread has heretofore been a laborious and difficult task.

In this regard, the carpeting of stairs has heretofore been accomplished by securing a first strip of carpet overlying and around the nose of the stair tread and then securing a second strip of carpet covering the underlying riser. More specifically, a length of carpet is secured to the stair tread adjacent the riser and stretched around the nose of the tread by manually gripping its free end and forcing the carpet around the nose and into the corner formed by the intersection of the stair tread and underlying riser. At this point, a staple gun is employed to secure the carpet adjacent the corner formed by the tread and underlying riser. Subsequently, any excess length of carpet is cut off at such corner and a second strip of carpet conforming to the size and shape of the riser is secured thereto by suitable staples.

From the foregoing technique, it can be appreciated that this prior art technique for installing carpet around the nose of a stair tread suffers from a number of notable disadvantages. For example, such installation by manual procedures is both laborious and time consuming, resulting in increased installation costs for the ultimate consumer. Further, such a manual installation technique often results in inconsistent quality of the installed carpet from stair-to-stair due to human error, inability to reproduce the same procedure from stair-to-stair and the like. Furthermore, the requirement of having to use individual pieces of carpet for the stair tread and riser is unsightly, subject to lifting at the corners and edges during use, as well as being less desireable than using a single piece of carpet to be installed over a plurality of stair treads and risers.

Accordingly, it can be appreciated that there is an unsolved need for a tool which is adapted for installing a continuous length of carpet on a plurality of stairs and, in particular, around the nose of a stair tread projecting outwardly from an underlying riser.

SUMMARY OF THE INVENTION

It is broadly an object of the present invention to provide a tool for installing carpet around a projection which overcomes or avoids one or more of the foregoing disadvantages resulting from the use of the above-mentioned prior carpet installation techniques and, which fulfills the specific requirements of such a tool for installing carpet around the nose of a stair tread. Specifically, it is within the contemplation of one aspect of the present invention to provide a tool for installing a continuous and uncut piece of carpet over a plurality of adjacent stairs comprising stair treads and underlying risers or the like.

A further object of the present invention is to provide a carpet installation tool adapted for installing carpet around the nose of a stair tread in a simple, reliable, repeatable and efficient manner.

A still further object of the present invention is to provide a carpet installation tool adapted for use with various types of carpeting, such as shag carpeting, plush carpeting, indoor or industrial carpeting, and the like.

In accordance with one embodiment of the present invention, there is provided a tool for installing carpet around a projection comprising a body having an opening adpated to receive a portion of a carpet to be installed around a projection and gripping means secured to the body and extending into the opening for releasably gripping that portion of the carpet to be installed.

In accordance with the above embodiment, the gripping means is constructed from a plurality of teeth arranged in at least one row extending along the longitundinal axis of the body. Further in this regard, the teeth extend into the opening along a radius of an imaginery circle defined by the body.

Still further in accordance with another aspect of the above embodiment, the plurality of teeth are provided on a strip removably secured to the body at an upper portion thereof for replacement as required during use.

Still even further in accordance with another aspect of the above embodiment, the plurality of teeth are provided on a plate pivotally secured at one end thereof to the upper portion of the body and having its other end arranged adjacent the lower portion of the body when the plate is arranged in a closed position.

Yet still even further in accordance with another aspect of the above embodiment, the gripping means is constructed of a ridge extending along the longitudinal axis of the body.

BRIEF DESCRIPTION OF THE DRAWINGS

The above description, as well as further objects, features and advantages of the present invention will be more fully understood by reference to the following detailed description of the presently preferred, but nonetheless illustrative, carpet installation tool when taken in conjunction with the accompanying drawings, wherein.

DETAILED DESCRIPTION

Figure 1:
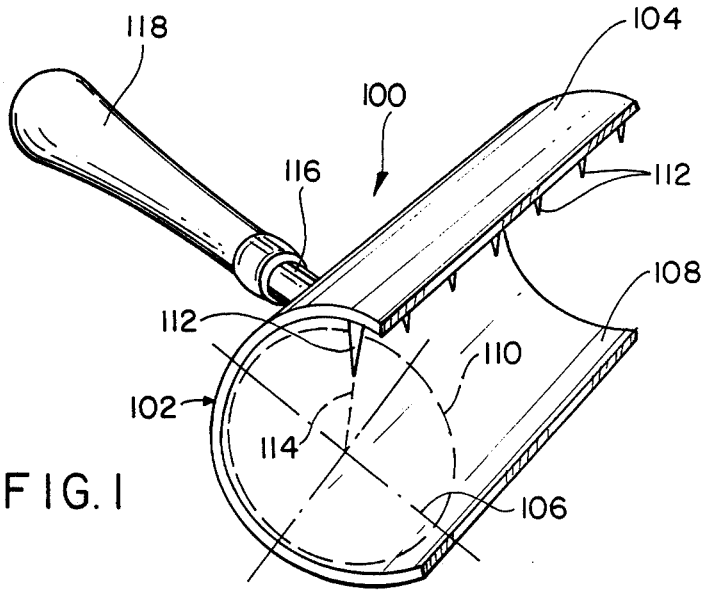
FIG. 1 is a perspective view of a carpet installation tool in accordance with the first embodiment of the present invention constructed of a body having a plurality of teeth arranged in a row extending along the longitudinal axis of the body at an upper portion thereof.

Referring generally to the drawings in which like reference characters represent like elements, there is shown in FIG. 1 a perspective view of a carpet installation tool in accordance with a first embodiment of the present invention generally designated by reference character 100. The tool 100 is constructed from a cylindrical body of generally C-shaped cross section having an upper portion 104 and lower portion 106 arranged along the circumference of the circular opening and a lower terminal end 108 extending outwardly along a line tangent to the circular opening and beyond the extent of the upper portion 104. This arrangement of the upper portion 104, lower portion 106 and lower terminal end 104 is clarified by reference to the imaginary circle 110, as shown in dotted lines, formed by the body 102. Gripping means or a plurality of teeth 112 are secured to the upper portion 104 of the body 102 and are arranged in a single row extending along the longitudinal axis of the body. In accordance with the embodiment shown, the teeth 112 are arranged to extend into the opening formed by the body 102 along a radius 114 of the imaginary circle 110. Although the teeth 112 have been described as a single row, it is to be understood that the teeth may be provided in multiple rows, in a uniform or random matrix, and extend into the opening formed by the body 102 other than along the radius 114 of the imaginary circle 110. Further, other than teeth 112 may be provided for securing a carpet to the body 102, for example, nails, spikes, and the like may be provided.

Secured to a central portion of the body 102 and extending outwardly therefrom is a rod 116 adapted to be secured to a suitable manipulating means or handle 118. The body 102 can be constructed from a variety of materials such as stainless steel, diecast aluminum and the like. The handle 118 is generally constructed from wood, however, plastic or other such synthetic materials are also suitable. The use of the tool 100 in accordance with the present invention will be described hereinafter with specific reference to FIG. 5.

Figure 2:
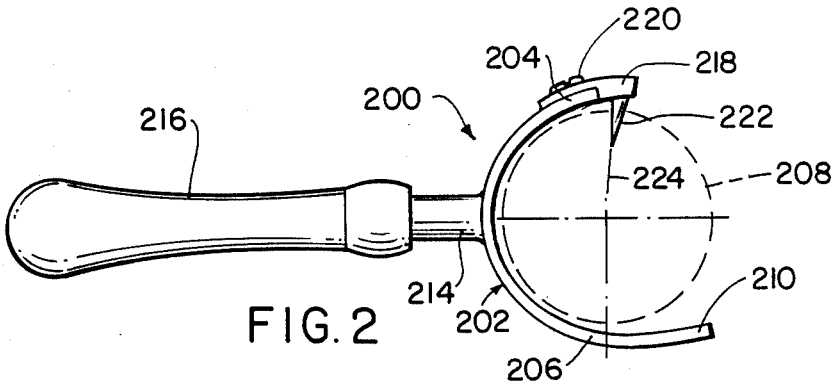
FIG. 2 is a side elevational view of the carpet installation tool in accordance with a second embodiment of the present invention having the plurality of teeth provided on a strip removably secured to the body for replacement thereof.

Referring now to FIG. 2, there is disclosed a carpet installation tool 200 constructed in accordance with a second embodiment of the present invention. Like the tool 100 of the first embodiment of the present invention, the tool 200 is constructed from a cylindrical body 102 of generally C-shaped cross section having an upper portion 204, a lower portion 206 both arranged along the circumference of an imaginary circle 208 defined by the body and a lower terminal end 210 extending outwardly beyond the extent of the upper portion 204. In this regard, the lower terminal end 210 extends generally along a line tangent to the imaginary circle 208 as previously noted with respect to the tool 100 of the first embodiment. A rod 214 extending outwardly from a center portion of the body 202 is adapted for securing a handle 216 thereto. As thus far described, the tool 200 in accordance with the second embodiment of the present invention is similar to the construction of the tool 100 in accordance with the first embodiment. A longitudinally extending strip 218 is secured by means of a plurality of bolts 220, screws or the like to the upper portion 204 of the body 202 overlying the lower portion 206. The strip 218 has secured thereto a single row of a plurality of teeth 222 projecting into the circular opening defined by the body 202. As shown, the teeth are arranged to extend into the opening along a radius 224 of the imaginary circle 208. However, as previously discussed, the teeth 222 may be arranged other than along the radius 224 and may be arranged in plural rows and in a uniform or random matrix. The ability to remove the strip 218 and attach teeth 222 permits replacement of the teeth should they become damaged or worn during use. In addition, the strip 218 may be replaced with a strip having other than teeth thereon, for example, such strip may include a hinged plate as to be described with respect to the embodiment disclosed in FIG. 3 or a rib as to be described with respect to the embodiment shown in FIG. 4. Furthermore, the strip 218 may be replaced with such a strip having teeth 22 of different or varying size as required by the specific carpet to be installed. It will be appreciated that the use of the tool 200 in accordance with the second embodiment of the present invention is generally the same as that with respect to the tool 100 in accordance with the first embodiment, which use will be described hereinafter with respect to FIG. 5.

Figure 3:
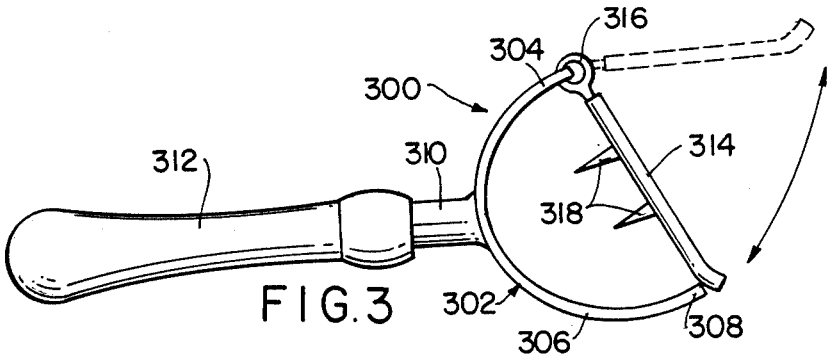
FIG. 3 is a side elevational view of a carpet installation tool in accordance with a third embodiment of the present invention wherein the plurality of teeth are provided on a plate pivotally secured at one end thereof to the upper portion of the body and having its other end arranged adjacent the lower portion of the body when the plate is arranged in a closed position.

Referring to FIG. 3, there is disclosed a carpet installation tool 300 in accordance with a third embodiment of the present invention. The tool 300 is constructed of a cylindrical body 302 generally of C-shaped cross section having an upper portion 304, a lower portion 306 both arranged along the circumference of the circular opening defined by the body and having a lower terminal end 308 extending along a line tangent to the circular opening as previously described with respect to the carpet tools 100, 200 of the first and second embodiments of the present invention. A rod 310 extends outwardly from a center portion of the body 302 and is adapted for securing a handle 312 thereto. It can thus be appreciated that the construction of the tool 300 in accordance with the third embodiment of the present invention is generally similar to that of the tools 100, 200 of the first and second embodiment as described with respect to FIGS. 1 and 2.

Further in accordance with the tool 300 of the third embodiment of the present invention, the tool is provided with a plate 314 pivotally secured at one end thereof by a hinge 316 to the upper portion 304 of the body 302 and extending therefrom such that its other end is arranged adjacent the lower portion 306 of the body by abutting against the lower terminal end 308. A plurality of teeth 318 arranged in a pair of parallel rows are secured to the underside of the plate 314 extending inwardly into the circular opening defined by the body 302. The teeth 318 extend outwardly from the plate 314 at an inclined angle. However, it is to be understood that the teeth 318 may be arranged normal to the plate 314, as well as being arranged in other than parallel rows such as a uniform or random matrix. The plate 314 is adapted to be pivotable between its closed position having one end abutting the lower terminal end 308 of the body 302 to an open position as indicated in dotted lines for engaging a carpet. In fact, the plate 314 may be pivoted about the hinge 316 such that the plate overlies the upper portion of the body 302. The specific use of the tool 300 in accordance with the third embodiment of the present invention will be described generally with respect to FIG. 5 when describing the specific use of the tool 100 in accordance with the first embodiment of the present invention.

Figure 4:
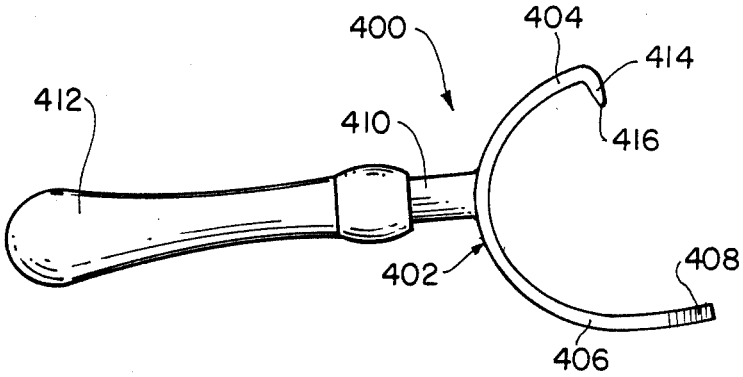
FIG. 4 is a side elevatioal view of a carpet installation tool in accordance with a fourth embodiment of the present invention wherein the plurality of teeth are replaced by a ridge extending along the longitudinal axis of the body at the upper portion thereof; and, FIG. 5 is a side elevational view in partial cross section showing the use of the carpet installation tool in accordance with the first embodiment of the present invention for installing a continuous length of carpet around the nose of a stair tread.

Referring to FIG. 4, there will now be described a carpet installation tool 400 in accordance with a fourth embodiment of the present invention. As previously described with respect to the tools 100, 200, 300, the tool 400 of the fourth embodiment of the present invention is similarly constructed from a cylindrical body 102 of generally C-shaped cross section having an upper portion 404, a lower portion 406 both arranged along circumference of the circular opening formed by the body and having a lower terminal end 408 arranged along a line tangent to the circular opening adjacent the lower portion. A rod 410 is secured to a central portion of the body 402 and extends outwardly therefrom and is adpated to secure a handle 412 thereto. The tool 400 is further provided with an inwardly projecting ridge 414 extending along the longitudinal axis of the body 402 adjacent the upper portion 404. The ridge 414 is provided without any teeth so as to form a smooth gripping edge 416 to engage various types of carpeting such as indoor and outdoor carpeting, as well as industrial carpeting of the type having a foam rubber backing and the like. The specific use of the tool 400 in accordance with the fourth embodiment of the present invention will be described hereinafter generally with respect to FIG. 5.

Figure 5:
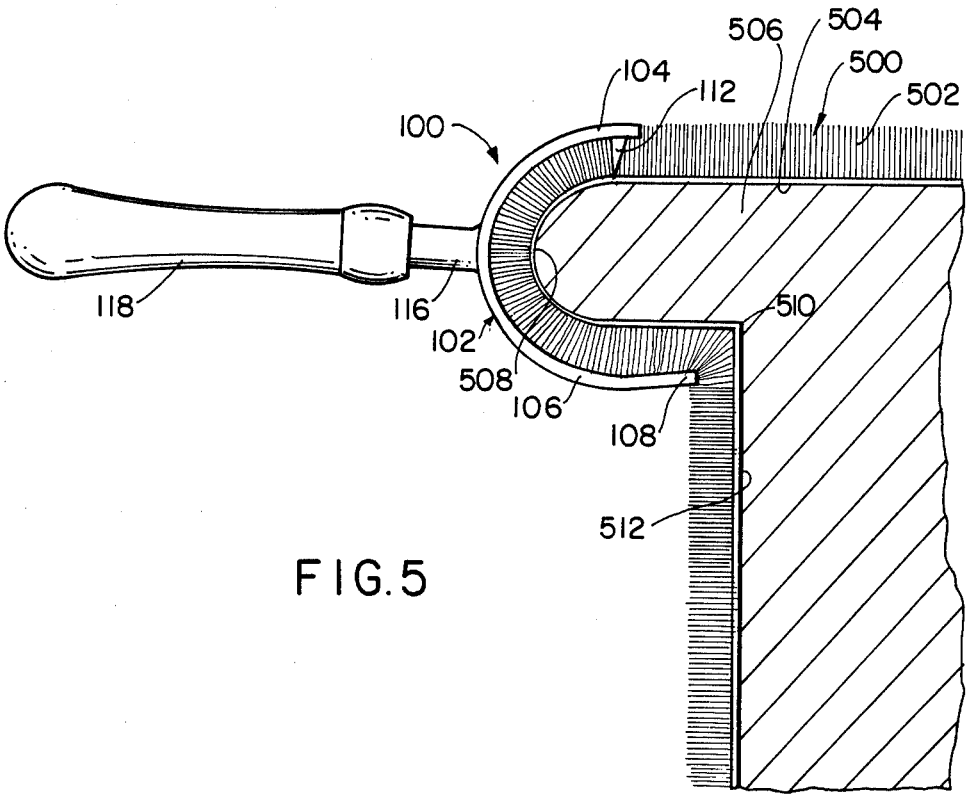

Referring to FIG. 5, the use of the tool 100 will now be described for installing a carpet 500 constructed of a pile 502 secured to a backing 504. As shown, the carpet 500 is installed in a continuous piece overlying a stair tread 506, around the projecting nose 508, into the corner 510 formed by the nose and underlying riser 512, and down over the face of the riser to the next underlying stair tread. In this manner, a single length of carpet may be installed over a plurality of stairs without having to cut the carpet into multiple segments as now to be described.

A continuous length of carpet 500 is secured to the topmost stair tread 506 of a plurality of stairs to be carpeted. The remainder of the carpet 500 may be partially rolled up to facilitate installation and handling. The carpet 500 is allowed to drape over the nose 508 of a stair tread 506 and down across the face of the underlying riser 512. If desired, the carpet 500 may be gently tucked into the corner 510 underlying the nose 508 prior to using the tool 100. In this regard, the tool 100 is initially positioned central of a stair tread 506 having the circular opening formed by the body 102 facing the nose 508. The tool 100 is manipulated by the handle 118 to engage a portion of the carpet 500 overlying the stair tread 504 at a location rearward of the furthermost project extent of the nose 508. The tilting of the handle 118 in an upward direction will cause the teeth 112 to penetrate the carpet 500 and to secure that portion of the carpet to be installed around the nose 508 to the body 102 adjacent the inside surface thereof. The tool 100 is tilted downward by means of the handle 118 with the teeth 112 acting as a pivot point at its secured position in the carpet 500 overlying the stair tread 504 adjacent the nose 508. As the tool 100 is pivoted downward, the carpet 500 is forced into tight coextensive engagement with the nose 508 by means of the body 102 and is wedged into the corner 510 by the terminal end 108 of the body 102. The carpet 500 is secured into the corner 510 by stapling along either side of the body 102. The tool 100 is moved several inches to the right or left of the carpet 500 as now installed around a portion of the nose 508 to effect installation of the carpet around an adjacent uninstalled portion. This installation technique using the tool 100 is repeated along the entire edge of the nose 508 of a stair tread 506 until the carpet 500 has been snugly installed around the nose and into the corner 510. The tool 100 is removed from its engagement with the carpet 500 each time by tilting the handle 118 upward so as to disengage the teeth 112 from the carpet. The remaining portion of the carpet is allowed to drape downward over the face of the riser 512 and overlying the adjacent stair tread 506. The carpet 500 is secured to the riser 512 and underlying stair tread 506 by means of staples, tacked strips or other such conventional means. The carpet 500 is installed overlying and around the nose 508 of the remaining stairs using the tool 100 in the manner as thus far described. It can therefore be appreciated that the tool 100 permits the installation of a continuous length of carpet 500 over a plurality of stairs and, in particular, around the nose 508 thereof, in an efficient, neat, convenient and easy technique. Accordingly, it can be appreciated that the use of the tool 100 to install carpet 500 around the nose 508 of a stair tread 506 projecting from and underlying riser 512 results in a superior carpet installation from a continuous length of carpet 500 over that of the prior art technique described herein.

The installation of a carpet 500 around the nose 508 of a stair tread 506 using the tool 200 in accordance with the second embodiment or the tool 400 in accordance with the fourth embodiment of the present invention is in accordance with the technique previously described with respect to the use of the tool 100 in accordance with the first embodiment of the present invention. Accordingly, the specific use of the tools 200, 400 for installing carpet 500 around a projection such as a nose 508 of a stair tread 506 will not be described.

From the previous description of the use of the tool 100, the use of the tool 300 in accordance with the third embodiment of the present invention should now be readily understood. Specifically, as to the tool 300, the plate 314 is pivoted upwardly by the hinged 316 so as to overlie the upper portion 304 thereby allowing access to the circular opening formed by the body 302. The tool 300 is now manipulated by the handle 312 to position the body 302 adjacent the nose 508 of a stair tread 506 with the carpet 500 arranged between the nose 508 and inner surface of the body 302. The plate 314 is pivoted via the hinge 316 in a clockwise direction to engage the carpet overlying the stair tread 506 adjacent the nose 508 by means of the plurality of teeth 318. The carpet 500 is now installed around the nose 508 and tucked into the corner 510 in the same manner as previously described with respect to the use of the tool 100. After the carpet 500 has been secured to the corner 510, the tool 300 may be removed from its engagement with the carpet by pivoting the plate 314 via hinge 316 in a counterclockwise direction to remove the teeth 318 from its penetration of the carpet. The tool 300 therefore facilitates the engagement and disengagement of the teeth 318 with the carpet during installation of same around the nose 508 of a stair tread 506 or other such projection.

In accordance with the present invention there has thus far been described a tool for installing carpet around the nose of a stair tread projecting outwardly from an underlying riser constructed from a body having a circular opening adapted to receive that portion of the carpet to be installed around the nose of the stair tread or the like, the body having an upper and lower portion arranged along the circumference of the circular opening, a plurality of teeth secured to the upper portion and projecting into the circular opening for releasably gripping the carpet and securing the carpet to the tool, and a handle attached to the body for manipulating the teeth into engagement with the carpet and installing the carpet around the nose of the stair tread or other such projection.

Although the invention herein has been described with reference to particular embodiments, it is to be understood that these embodiments are merely illustrative of the principles and application of the present invention. It is therefore to be understood that numerous modifications may be made in the illustrative embodiments and that other arrangements may be devised without departing from the spirit and scope of the present invention as defined by the appended claims.

What is claimed is:

1. A tool for installing carpet around the nose of a stair tread projecting outwardly from an underlying riser, said tool comprising a body having an elongated opening adapted to receive that portion of the carpet to be installed around the nose of a stair tread, said body including a hollow member having an upper portion and a lower portion arranged spaced-apart along the longitudinal axis of said body providing said opening therebetween, said upper portion having an upper edge and said lower portion having a lower edge, a plurality of teeth secured to said upper portion of said body adjacent said upper edge and projecting into said opening towards said lower portion for releasably securing said carpet at a first location to said tool, said lower edge extending to a location at least opposite the corresponding location of said teeth for engaging said carpet at a second location spaced from said first location, and a handle attached to said body for manipulating said teeth and said lower edge of said body simultaneously into releasable engagement respectively with said first location and said second location of said carpet while stretching said carpet around and under said nose of said stair tread, said teeth when engaging said carpet at said first location acting as a pivot point while said handle is manipulated for engaging said carpet at said second location with said lower edge for wedging said carpet at said second location into the intersection of said stair tread and said underlying riser.

2. The tool of claim 1 wherein said elongated opening has a circular cross-section.

3. The tool of claim 2 wherein said lower portion of said body extends beyond said upper portion of said body.

4. The tool of claim 3 wherein said lower portion of said body extends along a tangent line of an imaginery circle defined by said opening of circular cross-section.

5. The tool of claim 2 wherein said teeth are arranged in a row extending along the longitudinal axis of said body and extending into said opening along a radius of an imaginery circle defined by said opening of circular cross-section.

6. The tool of claim 1 wherein said plurality of teeth are secured to a strip removably secured to said upper portion of said body for replacement thereof.

7. The tool of claim 1 wherein said plurality of teeth are provided on a plate pivotally secured at one end thereof to said upper portion of said body and having its other end arranged adjacent said lower portion of said body when said plate is arranged in a closed position.

8. The tool of claim 1, wherein said body comprises a hollow cylindrical member having a longitudinally-extending section removed therefrom so as to provide said upper portion and said lower portion.

* * * * *